US006612577B1

(12) United States Patent
Tiffin

(10) Patent No.: US 6,612,577 B1
(45) Date of Patent: Sep. 2, 2003

(54) AMUSEMENT DEVICE

(76) Inventor: Wesley D. Tiffin, 1118 N. 14th St., Fort Smith, AR (US) 72901

( * ) Notice: Subject to any disclaimer, the term of this patent is extended or adjusted under 35 U.S.C. 154(b) by 0 days.

(21) Appl. No.: 09/997,985

(22) Filed: Nov. 30, 2001

(51) Int. Cl.[7] ..... A63F 9/04

(52) U.S. Cl. ..... 273/146; 273/143 A; 273/440; 273/288

(58) Field of Search ..... 273/146, 143 A, 273/440, 288; 473/566

(56) References Cited

U.S. PATENT DOCUMENTS 3,712,627 A 1/1973 Stroud
4,290,606 A 9/1981 Maxwell
4,543,067 A 9/1985 Wallen
5,505,462 A * 4/1996 Loewen ..... 273/440
5,833,237 A * 11/1998 Velich ..... 273/146
6,007,065 A * 12/1999 Ress ..... 273/146
6,045,469 A 4/2000 Gleason et al.
6,318,725 B1 * 11/2001 Saint-Victor ..... 273/447
6,405,974 B1 * 6/2002 Herrington ..... 242/609.4

* cited by examiner

*Primary Examiner*—Benjamin H. Layno
(74) *Attorney, Agent, or Firm*—Sturm & Fix LLP

(57) ABSTRACT

The present invention is a lightweight plastic toy that is used in a game of chance. The toy includes a cylindrical body having a central axial bore defined by an interior wall; and a plurality of open cells defined by the interior wall, a concentric exterior wall, and a number of radial webs. The body includes first and second opposing ends that lie in planes perpendicular to the axial bore. The toy is used to play a game where the toy is tossed onto a planar surface and bounces until it comes to rest. Various outcomes are assigned depending on whether the toy comes to rest with the exterior wall or the first or second ends remaining in contact with the planar surface. The outcomes may relate to any number of subjects such as a sporting event or fortune telling.

2 Claims, 1 Drawing Sheet

AMUSEMENT DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of amusement devices, and more particularly to a toy used as a game piece in a game of chance.

2. Description of Related Art

As can be seen by reference to the following U.S. Pat. Nos. 3,712,627; 4,290,606; 4,543,067 and 6,045,469, the prior art is replete with myriad and diverse amusement devices.

While all of the aforementioned prior art constructions are more than adequate for the basic purpose and function for which they have been specifically designed, they are uniformly deficient with respect to their failure to provide a simple, efficient, and practical toy that is used in a game of chance.

As a consequence of the foregoing situation, there has existed a longstanding need for a new and improved toy used in a game of chance and the provision of such a construction is a stated objective of the present invention.

BRIEF SUMMARY OF THE INVENTION

Briefly stated, the present invention provides a lightweight plastic toy that is used in a game of chance. The toy includes a cylindrical body having a central axial bore defined by an interior wall; and a plurality of open cells defined by the interior wall, a concentric exterior wall, and a number of radial webs. The body includes first and second opposing ends that lie in planes perpendicular to the axial bore. The toy is used to play a game where the toy is tossed onto a planar surface and bounces until it comes to rest. Various outcomes are assigned depending on whether the toy comes to rest with the exterior wall or the first or second ends remaining in contact with the planar surface. The outcomes may relate to any number of subjects such as a sporting event or fortune telling.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
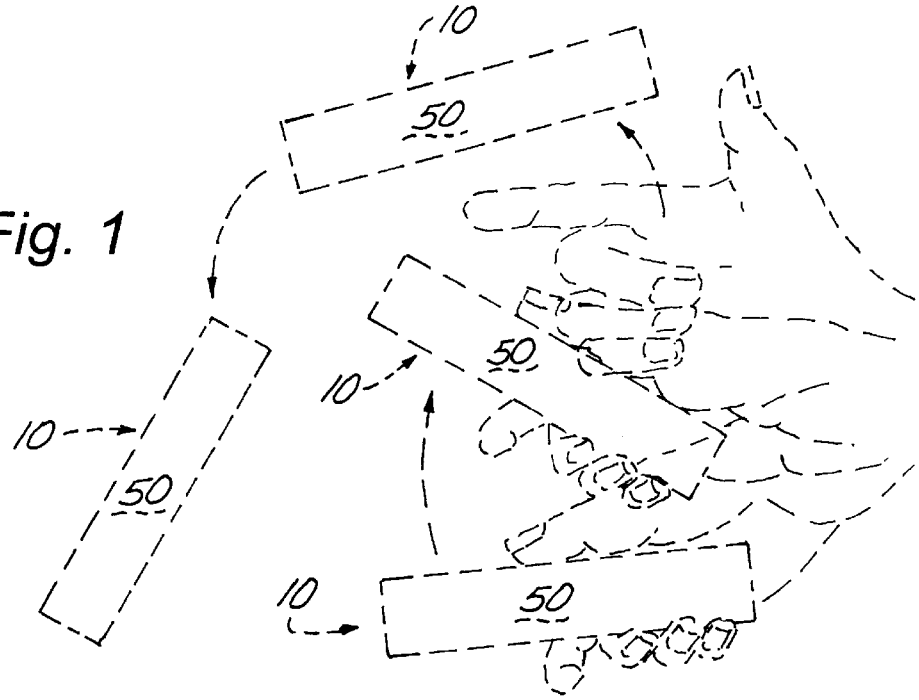
FIG. 1 is a perspective view illustrating the toy of the present invention being tossed to land and bounce on a surface.

As can be seen by reference to the drawings, and in particularly to FIG. 1, the toy that forms the basis of the present invention is designated generally by the reference number 10. The toy 10 has a cylindrical body 20 that includes an axial bore 30 with a diameter defined by an interior wall 40. An exterior wall 50 is disposed out from and concentric with the interior wall. A number of equally spaced radially directional webs 60 interconnect the interior and exterior walls 30 and 40 to form a number of open cells 70. The body 20 has a first end surface 80 and an opposite second end surface 90 that are disposed to lie in planes perpendicular to the axial bore 30. The body 20 is constructed of lightweight plastic or another suitable material that will bounce when tossed onto a planar surface 100.

Figure 2:
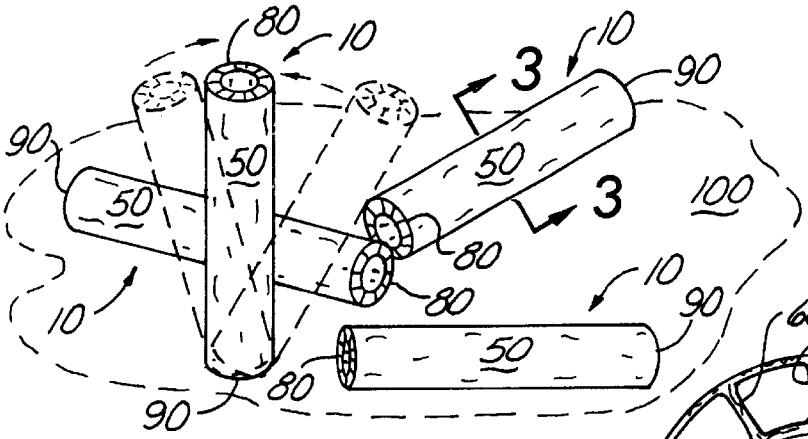
FIG. 2 is a perspective view showing four of the toys as they have come to rest on the surface where one of the toys is standing upright.
Figure 3:
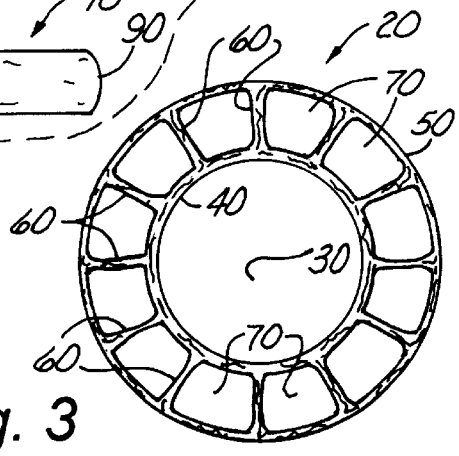
FIG. 3 is an enlarged sectional view taken along line 3—3 showing the cross-section of the toy.

The toy 10 is used to play a game where the toy 10 is tossed onto a planar surface 100 such as a table or a floor. The toy 10 bounces until it comes to rest either on its side where the exterior wall 50 is in contact with the planar surface 100, or on one of its ends 80 or 90 where the body 20 comes to rest in an upright position. Due to the shape of the toy 10 shown in FIGS. 1–3, where the body length is greater than the diameter, it is most likely that the toy 10 will come to rest on its side. As the body length decreases with respect to the diameter, the likelihood that the toy 10 will come to rest on one of its ends 80 or 90 increases. In any case, whether the toy 10 comes to rest on its side or one of its ends is a matter of chance.

Various outcomes are assigned depending on the position of the toy 10 when it comes to rest. These outcomes may be related to various sporting events, to fortune telling, or to numerous other subjects. Stickers may also be applied to the toy 10 to enhance its versatility.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A method of playing a game using a toy comprising a cylindrical body having an outside diameter and including an axial bore having an internal diameter, an interior axially oriented wall defining the diameter of the axial bore, and exterior axially oriented wall disposed exterior of and concentric with the interior wall, and a plurality of equally spaced radially directed connecting webs attached to and interconnecting the interior wall and the exterior wall where adjacent webs define open cells, and wherein, the value of the inside diameter is less than three times the value of the spacing between the inside diameter and the outside diameter the cylindrical body including a first end surface disposed to lie in a plane perpendicular to the axial bore, and a second end surface disposed to lie in a plane perpendicular to the axial bore, the method of playing the game comprising the steps of:

throwing the toy onto a planar surface;

assigning a first outcome when the toy comes to rest where the exterior wall of the cylindrical body remains in contact with the planar surface; and assigning a second outcome when the toy comes to rest where the first end surface remains in contact with the planar surface and the cylindrical body stands upright.

2. The method of claim 1 further including the step of:

assigning a third outcome when the toy comes to rest where the second end surface remains in contact with the planar surface and the cylindrical body stands upright.

* * * * *